United States Patent [19]

Ballard

[11] 4,164,909

[45] Aug. 21, 1979

[54] WIND DRIVEN HYDROFOIL WATERCRAFT

[76] Inventor: James S. Ballard, 59 Strathmore Rd., Camps Bay, Cape Town, Cape Province, South Africa

[21] Appl. No.: 888,298

[22] Filed: Mar. 20, 1978

Related U.S. Application Data

[63] Continuation of Ser. No. 740,115, Nov. 8, 1976, abandoned.

[30] Foreign Application Priority Data

Nov. 19, 1975 [ZA] South Africa ..... 75/7269

[51] Int. Cl.[2] ..... B63B 1/30

[52] U.S. Cl. ..... 114/282; 114/39; 114/274

[58] Field of Search ..... 114/39, 274, 280, 281, 114/282

[56] References Cited

U.S. PATENT DOCUMENTS

| | | | |
|---|---|---|---|
| 2,484,687 | 10/1949 | Carl | 114/39 X |
| 2,856,879 | 10/1958 | Baker | 114/281 X |
| 2,887,979 | 5/1959 | Bader | 114/282 |
| 2,914,014 | 11/1959 | Carl et al. | 114/281 |
| 3,168,067 | 2/1965 | Graig | 114/280 X |
| 3,200,781 | 8/1965 | Takagi | 114/282 |
| 3,561,388 | 2/1971 | Keiper | 114/281 |
| 3,580,203 | 5/1971 | Martin | 114/39 |
| 3,802,369 | 4/1974 | Ishimoto | 114/282 |
| 3,911,845 | 10/1975 | Holtom | 114/274 X |

*Primary Examiner*—Barry L. Kelmachter
*Attorney, Agent, or Firm*—Prutzman, Kalb, Chilton & Alix

[57] ABSTRACT

The invention concerns a water craft comprising a hull, a front hydrofoil and a rear hydrofoil depending downwardly from the hull, a hydrofoil depending outwardly from each side of the hull at an angle below the horizontal, a sail wing or the like for enabling the hull to move forwards and control members for altering the position of at least some of the hydrofoils.

5 Claims, 6 Drawing Figures

WIND DRIVEN HYDROFOIL WATERCRAFT

This is a continuation application of copending application Ser. No. 740,115, filed Nov. 8, 1976, entitled "A Hydrofoil Watercraft," now abandoned.

This invention relates to a water craft.

The present invention provides a water craft comprising a hull, a front hydrofoil and a rear hydrofoil both depending downwardly from the hull, a hydrofoil depending outwardly from each side of the hull at an angle below the horizontal, means for enabling the hull to move forwards, and means for altering the position of at least some of the hydrofoils.

The hull may be generally cigar shaped, like an aircraft fuselage-type hull, or cigar-stub shaped, to provide a weatherproof enclosure for the occupants thereof, and may have a cockpit with controls at the front. The top of the cockpit may be of a transparent material to give good all-round transparency. The hull has sufficient buoyancy that, when the craft is not moving over the water on the hydrofoils, the hull will float on the water.

Any convenient means may be provided for enabling the hull to move forwards. For example, a wing or sail can extend upwardly above the top of the fuselage. The angle of at least part of the wing or sail relative to the longitudinal axis of the hull may be adjustable so that it can take up a plurality of positions in relation to the longitudinal axis of the hull. I presently prefer a wing for ease of handling in winds of a speed frequently found in coastal areas.

The wing may be in two sections, namely a fabric covered rear section and a rigid forward section of glass-reinforced plastics material or metal covered framework. The wing can be pivotally mounted so that the angle in relation to the fuselage axis can be altered as desired. I have found it convenient to mount the wing about the front section in a pivotal manner, so that the complete wing may pivot. The movement is about a vertical axis, and can be controlled from the cockpit.

The forward wing section may comprise a glass-reinforced plastics casing and a plywood sheeting rear covering or an aluminium framework covered by aluminium sheeting. The rear wing section may comprise a flexible wooden frame, or an aluminium frame, covered with fabric, eg terylene. The rear wing section may be demountable and may comprise a plurality of frames. The rear wing section may be erected by pulling the frames upwards, with the front edges of the frames moving in a sliding track at the rear of the front wing section. A rope passing over a pulley can be used to enable the rear wing section to be erected. Control means, eg a separate rope controlled from the cockpit, can act on a boom under the wing so that the wing can be inclined to the prevailing wind.

The hydrofoils depending outwardly and downwardly from each side of the hull form the main supporting hydrofoils for the craft. These hydrofoils are monoplane main supporting hydrofoils at an angle of about 20 to 30 degrees, conveniently, at about 26.5 degrees, below the horizontal. Each main supporting hydrofoil can be pivotally mounted about a support in the fuselage, so that the angle between the longitudinal axis of the hydrofoil and the longitudinal axis of the fuselage can be altered. The fuselage may have slots along its sides, into which the main supporting hydrofoils can be retracted. Conveniently, each main supporting hydrofoil can be mounted on a spindle passing through a bush which is mounted about a support in the fuselage. The hydrofoils may be biassed towards an angle of about 90 degrees to the fuselage axis. The bias can be a spring so that any damage to the hydrofoil on hitting a solid object can be minimised. The mounting of each main supporting hydrofoil about the support in the fuselage may be a pivotal mounting to enable the hydrofoil to be pivoted in a clockwise or anti-clockwise direction and so alter its angle to the longitudinal axis of the hull. Controls provided in the cockpit can act on a lever fast on each spindle thereby enabling each main supporting hydrofoil to be pivoted about its longitudinal axis. Adjustment of each of the main supporting hydrofoils about its longitudinal axis can alter the angle of the lateral axis of the craft in relation to the water level.

The front hydrofoil conveniently is positioned centrally between the two main supporting hydrofoils. This hydrofoil conveniently is vertical, but may be retracted into the fuselage along a vertical plane. This hydrofoil also may be biassed towards its maximum extended position so that, on hitting a solid object, it is moved against the bias towards the retracted position, thereby minimising damage to it. The front hydrofoil may comprise a single downwardly extending limb.

The rear hydrofoil conveniently is so mounted as to enable the complete hydrofoil to be controlled about a lateral axis and to be lowered into and raised from the water. The mounting is such as to enable the hydrofoil to be pivoted in a clockwise or anti-clockwise direction about its longitudinal axis, thereby enabling the craft to be steered. For example, the hydrofoil may be fixedly mounted on a spindle passing through a bushing having arms extending outwardly therefrom. A cross member fast with the spindle may enable the spindle to be turned clockwise or anti-clockwise. The arms extending outwardly from the bushing may be pivotally mounted in bushings, thereby enabling the complete hydrofoil to be either controlled about a lateral axis or to be lifted out of the water. The hydrofoil can be weighted to assist in balancing the craft, so that the craft floats on the water in an upright position. Conveniently, the rear hydrofoil may comprise a substantially vertical weighted tail to act as a steering hydrofoil, and a lateral wing or a pair of lateral wings thereon.

As with the other hydrofoils, the rear hydrofoil may also pivot rearwardly against a bias on striking a solid object, thereby minimising damage to the hydrofoil.

The invention is illustrated by reference to the accompanying drawings, in which.

Figure 1:
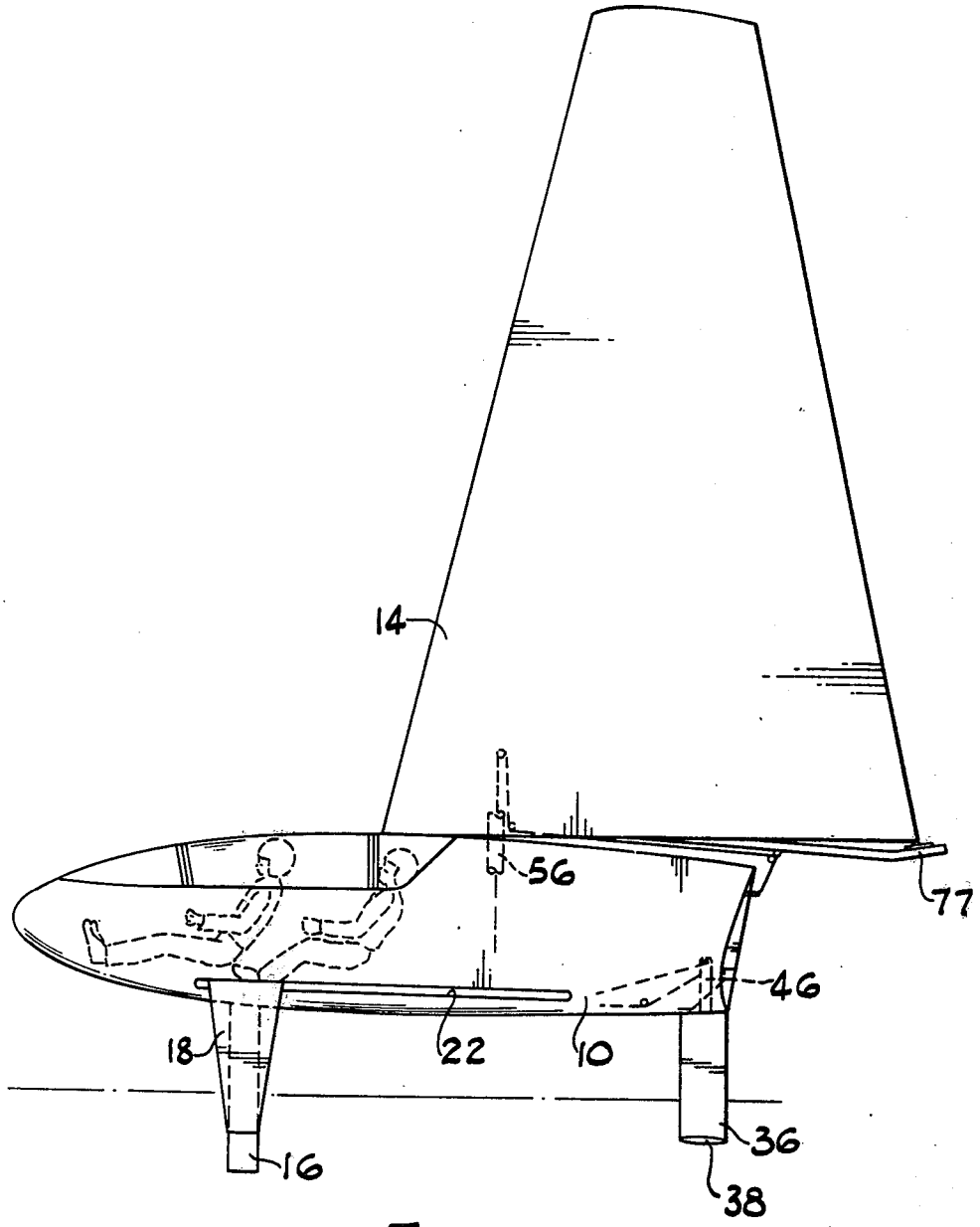
FIG. 1 is a side elevation of a craft according to the invention, the craft being in the moving position and supported on hydrofoils.
Figure 2:
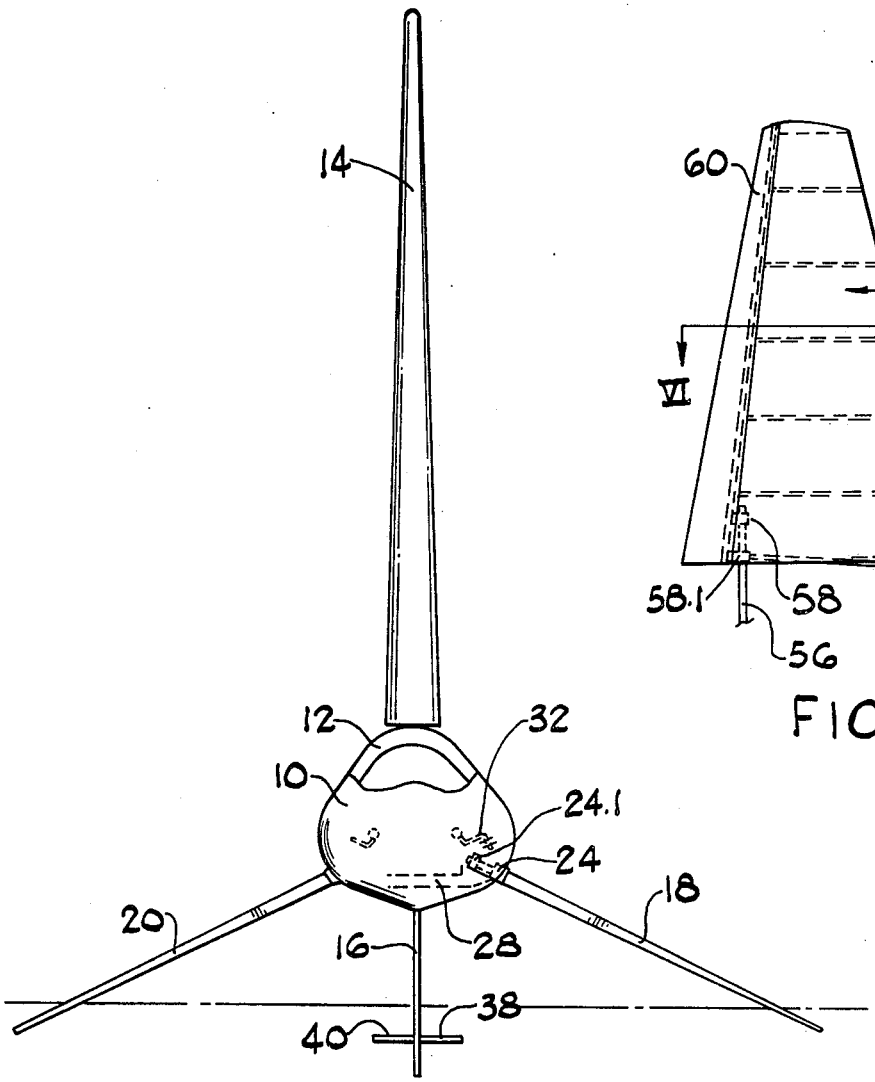
FIG. 2 is a front elevation of the craft.

In FIGS. 1 and 2, the water craft comprises a fuselage 10 provided with a cockpit 12. A wing 14 extends upwardly from the top of the fuselage 10, while front and rear hydrofoils 16, 17 extend vertically downwards from the centre of the fuselage. Main supporting hydrofoils 18, 20 extend out through slots 22 from the fuselage. The upper surfaces of the main supporting hydrofoils are at an angle of 26.5 degrees below the horizontal.

Figure 3:
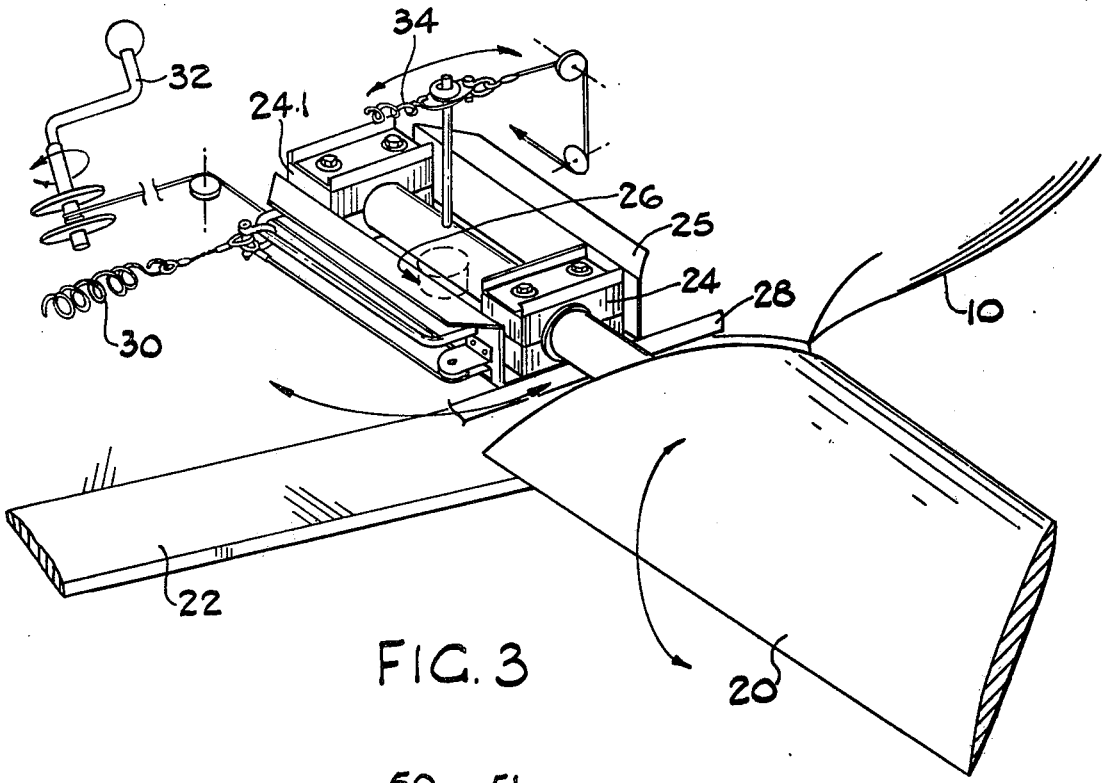
FIG. 3 shows schematically the mounting of one main supporting hydrofoil in detail.

Referring to FIGS. 1 and 3, the main supporting hydrofoils 18, 20 extending from the hull 10, are pivotally mounted on pivotal mountings about the fuselage frame (omitted from the drawing for simplicity). The pivotal mountings comprising bushings 24, 24.1 which are fast with a bearing plate 25. The bearing plate 25 is fast with a spindle 26 which is pivotally mounted in sub frame 28. The bearing plate 25 is biassed by a spring 30 attached to the fuselage frame towards a stop on the sub frame 28. The complete main supporting hydrofoil 20 is pivotally mounted in the bushings 24, 24.1. The pivotal mounting and hydrofoil can be pivoted into slot 22 on moving operating winch 32. By operating controls in the cockpit, the main supporting hydrofoils 18, 20 can be pivoted in the bushings 24 and 24.1 against the bias of spring 34 which is also attached to the fuselage frame.

Figure 4:
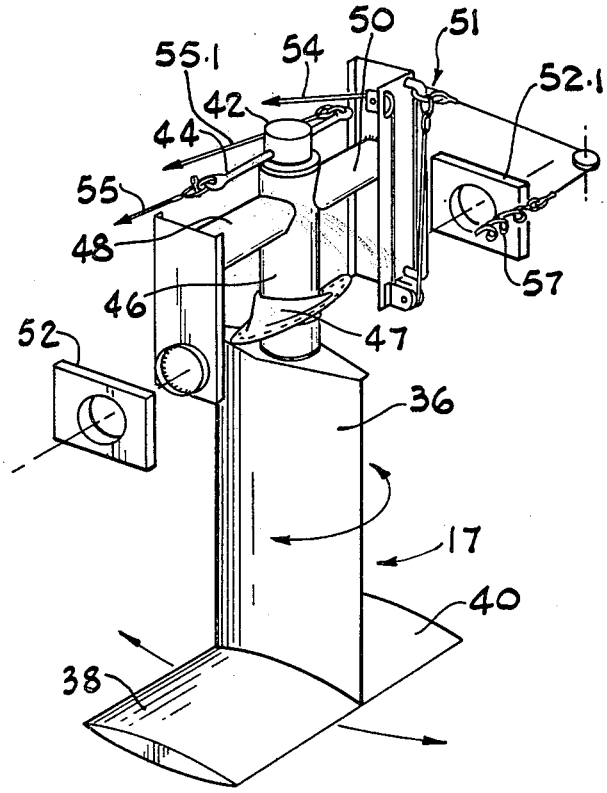
FIG. 4 is a schematic perspective view of the rear hydrofoil.

Referring to FIGS. 1 and 4, the rear hydrofoil 17 comprises a weighted tail 36 having a pair of lateral wings 38, 40 extending outwardly therefrom. The lateral wings 38 and 40 act as lifting hydrofoils and the weighted tail 36 acts as a steering hydrofoil. The tail 36 is fast with a spindle 42, the upper end of which is fast with a crossmember 44. The spindle 42 passes through a bushing 46, to the exterior of which are fitted cross-arm assemblies 48, 50. The cross-arm assemblies 48, 50 are pivotally mounted in bushings 52, 52.1 which are fast with the fuselage 10. A cable 54 from a control in the cockpit leads to a sliding attachment 51 on the cross-arm assembly 50 thereby enabling the complete rear hydrofoil 17 to be lifted out of the water. Cables 55, 55.1 from pedals and a joystick in the cockpit lead to the crossmember 44. These cables enable the hydrofoil 17 to be pivoted both within bushings 52, 52.1 and bushing 46. Spring 57 acts against the bias of cables 55, 55.1. A rubber membrane 47 provides a watertight seal between the bush 46 and the fuselage 10.

Figure 6:
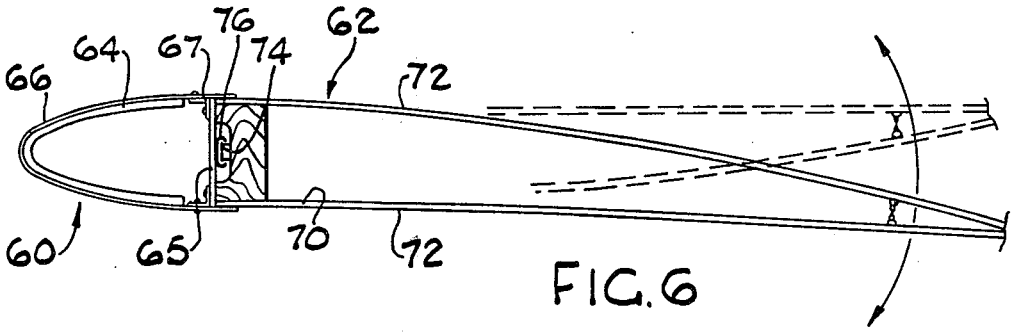
FIG. 6 is a section along VI—VI through the wing.
Figure 5:
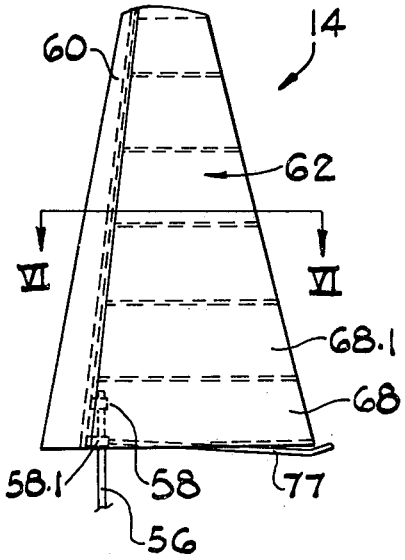
FIG. 5 is a side elevation of the wing.

Extending upwardly from the top of the fuselage (see FIGS. 5 and 6) is a tube 56 on which bushings 58, 58.1 are pivoted. The tube 56 is fast with the fuselage 10. The wing 14 comprises a front section 60 and a rear section 62. The front section 60 has plastics stiffeners 64 with a glass fibre-reinforced plastics outer casing 66 and plywood rear covering 65. The glassfibre-reinforced casing 66 and the plywood covering 65 are joined together by aluminium angle sections 67. The rear section 62 comprises a plurality of sections 68, 68.1 etc, each having a flexible wooden frame 70 covered with the material 72 known by the Registered Trade Mark 'Terylene'. The end of each frame 70 has projections 74 sliding in track 76. The forward end of a boom 77 is pivotally mounted behind the front section 60. The horizontal movement of the boom 77 in relation to the front section 60 is limited by stops on the boom.

With the present invention, when the craft is affected by a heavy gust of wind, the fuselage can be permitted to approach the water surface in a longitudinal rolling action. By partially or completely retracting the hydrofoils, docking is simplified. The likelihood of the craft being damaged is reduced since the hydrofoils can pivot towards the fuselage on hitting a solid object. It is estimated that the speeds of about 25 knots (±50 km/h) should easily be possible with the craft illustrated, and that the fuselage should lift out of the water at about 7 knots.

The side thrust of the wing is counteracted by the rear hydrofoil and partly by the vertical parts of the front hydrofoil. The operation of the controls may be briefly explained as follows:

(a) By pressing the right hand pedal in the cockpit the craft is steered to the right.

(b) By pressing the left hand pedal in the cockpit the craft is steered to the left. (c) By pushing the joystick to the right each main supporting hydrofoil is pivoted about its longitudinal axis so that the front edge of the right hand main supporting hydrofoil drops. The craft then rolls to the right.

(d) By pushing the joystick to the left the procedure as mentioned in (c) above is reversed and the craft rolls to the left.

(e) By pulling the joystick rearwards, the cables 55 and 55.1 to the crossmember 44 are both pulled forwards. The whole of the rear hydrofoil is therefore pivoted about an axis passing through the bushings 52 and 52.1 so that the lower end of the rear hydrofoil moves rearwards. Consequently the horizontal surfaces of the rear hydrofoil lose their lifting force and the rear end of the craft drops. The front end of the craft therefore rises higher above the water.

(f) By pushing the joystick forwards the reverse of (c) above occurs and the craft dives towards the water surface.

The watercraft can be docked easily in crowded moorings, or stored, on reducing its effective width by retracting the main hydrofoils without losing any of the operating features normally desired in a craft of this type.

I claim:

1. A wind driven watercraft comprising a buoyant hull having a fuselage frame and capable of floating on water when the craft is stationary, a singlebladed side-hydrofoil depending radially outwardly from each side of the hull in a continuously diverging direction relative to each other and at an angle below the horizontal when the craft is stationary whereby said side-hydrofoils form an inverted V-shaped configuration, said side-hydrofoils being positioned forwardly of the center of gravity of the watercraft, a single blade front hydrofoil mounted centrally between said side-hydrofoils and depending vertically downwardly from said hull, said side-hydrofoils being pivotally mounted with respect to the frame on pivotal mountings to enable the ends of said hydrofoils to be movable towards the hull about the pivotal mountings and to enable said side-hydrofoils to be pivoted independently of each other about their longitudinal axes during wind driven operation of the watercraft, a rear hydrofoil depending downwardly from the hull, said rear hydrofoil being pivotally mounted with respect to the frame and capable of moving in a clockwise and anti-clockwise direction about its longitudinal axis to steer the craft, means for enabling wind to drive the hull forward, a cockpit towards an upper part of the hull and control means in the cockpit and linked to the side and rear hydrofoils for enabling the position of the side and rear hydrofoils about their pivotal mountings to be altered, said craft being capable of being supported and traveling on the hydrofoils when in motion.

2. A watercraft according to claim 1, wherein the means for enabling wind to drive the hull forward, comprises a wing extending upwardly above the top of the hull from a mounting means which is fitted to the frame at a position rearwardly of the side-hydrofoils, at least part of the wing being pivotable about the mounting means.

3. A watercraft according to claim 1, wherein the hull is provided on each side with an elongated slot out of which one of the single bladed side-hydrofoils projects, said slot being of a length which is longer than the single bladed side-hydrofoil to enable the single bladed side hydrofoil to fit within the hull when pivoted rearwardly towards the hull about its pivotal mounting and against a bias.

4. A watercraft according to claim 1, wherein the rear hydrofoil is fast with a spindle extending longitudinally from the upper end of said rear hydrofoil, the spindle passing through a bushing to be capable of clockwise and anti-clockwise movement about the longitudinal axis of the hydrofoil, cross arm assemblies extending outwardly from the bushing, said cross arm assemblies being pivotally mounted on the frame about an axis which is horizontal when the craft is stationary, the pivotal mounting being such that if the rear hydrofoil strikes a solid object, the rear hydrofoil may pivot rearwardly against a bias to minimize damage to the hydrofoil, said control means in the cockpit being linked to the cross arm assemblies for enabling the rear hydrofoil to be pivoted out of the water about the pivotal mountings of the cross arm assemblies.

5. The watercraft according to claim 1 wherein the side-hydrofoils and the front hydrofoil are positioned in substantial alignment in a direction transversely of the hull.

* * * * *